US007963613B2

(12) United States Patent
Felmeri

(10) Patent No.: US 7,963,613 B2
(45) Date of Patent: Jun. 21, 2011

(54) PADDED SHOWER SEATS

(75) Inventor: Ian Felmeri, Castletown (GB)

(73) Assignee: DLP Limited, Isle of Man, British Isles (GB)

( * ) Notice: Subject to any disclaimer, the term of this patent is extended or adjusted under 35 U.S.C. 154(b) by 664 days.

(21) Appl. No.: 12/020,041

(22) Filed: Jan. 25, 2008

(65) Prior Publication Data

US 2008/0196154 A1 Aug. 21, 2008

(30) Foreign Application Priority Data

Feb. 17, 2007 (GB) ..... 0703131.3

(51) Int. Cl.
*A47C 7/00* (2006.01)

(52) U.S. Cl. ..... 297/440.22; 297/214; 24/297; 24/293; 24/289; 4/578.1

(58) Field of Classification Search ..... 297/440.22, 297/214; 4/578.1, 579; 24/297, 289, 453, 24/457, 458, 105, 293, 294, 295
See application file for complete search history.

(56) References Cited

U.S. PATENT DOCUMENTS 541,005 A * 6/1895 O'Meara ..... 297/440.22
1,962,035 A * 6/1934 Reiter ..... 402/63
2,589,028 A * 3/1952 Poupitch ..... 411/352
2,997,339 A * 8/1961 Wilson ..... 297/239
3,019,498 A * 2/1962 Brown ..... 24/297
3,751,109 A * 8/1973 Dufton ..... 297/445.1
3,851,920 A * 12/1974 Harris et al. ..... 297/452.55
3,873,155 A * 3/1975 Barecki ..... 297/451.4
3,948,557 A * 4/1976 Barecki ..... 297/283.2
4,568,124 A * 2/1986 Kanai ..... 297/440.22
4,762,437 A * 8/1988 Mitomi ..... 403/11
4,890,966 A * 1/1990 Umezawa ..... 411/340
5,152,582 A * 10/1992 Magnuson ..... 297/440.2
5,335,377 A 8/1994 Masyada et al.
5,390,378 A 2/1995 Janisch
5,499,862 A * 3/1996 Janisch ..... 297/311
5,779,317 A * 7/1998 Neal ..... 297/440.2

(Continued)

FOREIGN PATENT DOCUMENTS

DE 16 54 399 A1 2/1971

(Continued)

OTHER PUBLICATIONS

British Search Report for GB 00703131.3.

(Continued)

*Primary Examiner* — David Dunn
*Assistant Examiner* — Davie E Allred
(74) *Attorney, Agent, or Firm* — Martin Fleit; Paul D. Bianco; Fleit Gibbons Gutman Bongini & Bianco PL

(57) ABSTRACT

A padded shower seat for use when showering, the shower seat comprising a seat element having one or more openings therein, and a padded element engaged with the seat element, the padded element including one or more integrally formed projections push-fit received in a respective said opening and at least one reinforcing element associated with at least one said projection for preventing or inhibiting unintentional disengagement of the padded element from the seat element, or damage to the padded element, during lateral urging of the padded element parallel to the seat element. A water-resistant padded element and a reinforcing element are also provided.

7 Claims, 7 Drawing Sheets

U.S. PATENT DOCUMENTS

| | | | | |
|---|---|---|---|---|
| 6,105,183 | A * | 8/2000 | Bly | 4/579 |
| 6,279,998 | B1 * | 8/2001 | Chu et al. | 297/440.22 |
| 6,378,945 | B1 * | 4/2002 | Krueger | 297/440.22 |
| 6,378,947 | B1 * | 4/2002 | Barber et al. | 297/452.25 |
| 6,497,011 | B2 * | 12/2002 | Smith et al. | 24/295 |
| D501,611 | S * | 2/2005 | Self et al. | D6/362 |
| 7,004,666 | B2 * | 2/2006 | Kozlovski | 403/252 |
| 7,077,478 | B2 * | 7/2006 | Nakamura | 297/452.18 |
| 7,222,398 | B2 * | 5/2007 | Koike | 24/297 |
| 7,234,780 | B2 * | 6/2007 | Lipniarski | 297/461 |
| D580,188 | S * | 11/2008 | Self et al. | D6/353 |
| 7,549,702 | B2 * | 6/2009 | Meyers | 297/344.18 |
| 7,676,893 | B2 * | 3/2010 | Gibbons et al. | 24/295 |
| 7,690,730 | B2 * | 4/2010 | Yasuda et al. | 297/440.22 |
| 2002/0026693 | A1 * | 3/2002 | Akema et al. | 24/453 |

FOREIGN PATENT DOCUMENTS

| | | |
|---|---|---|
| DE | 93 18 357 U1 | 2/1994 |
| DE | 199 34 571 A1 | 1/2001 |
| GB | 3011016 | 2/2003 |
| GB | 2428736 | 2/2007 |
| JP | 2007061509 | 3/2007 |

OTHER PUBLICATIONS

European Search Report completed Aug. 20, 2009 for European Application No. 08250288.

* cited by examiner

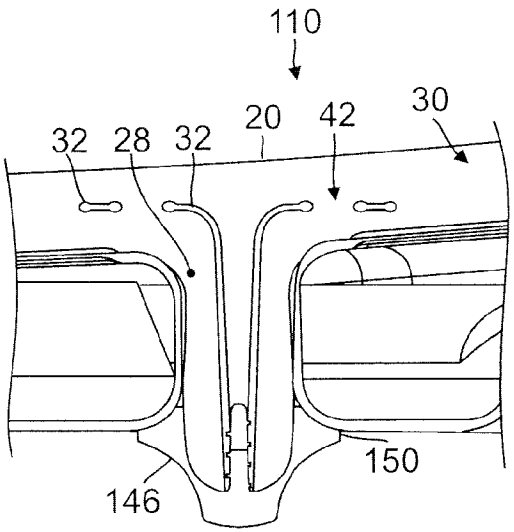
FIG. 5
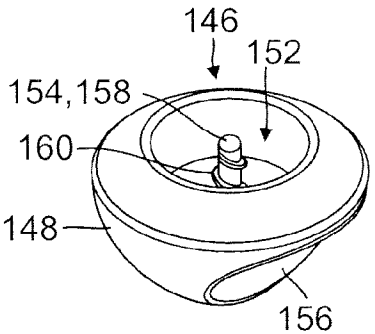
FIG. 6
FIG. 7
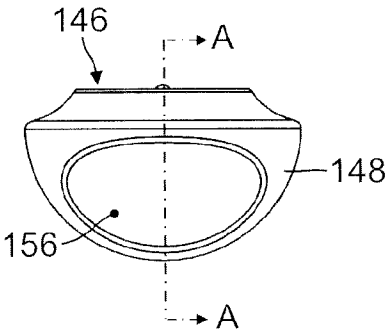
FIG. 8
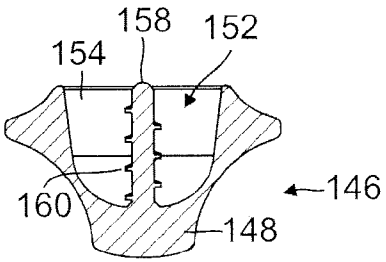
FIG. 9

PADDED SHOWER SEATS

BACKGROUND OF THE INVENTION

The present invention relates to a padded shower seat having a removable padded element.

A padded shower seat is known from British registered design 3011016. A padded element is provided both on the seat portion as well as on the seat back. Each padded element is removably engaged with the seat portion and the back via integrally formed projections or lugs on the rear of the padded element which are receivable as a push-fit in corresponding openings formed in the seat portion and the seat back.

However, these shower seats are typically used by the elderly and infirm, and transfer of the user to the shower seat can often be from a wheelchair or similar device. During such a transfer, the padded element, particularly on the seat portion, is subjected to quite significant lateral urging or loading parallel to the seat portion. In other words, the padded element is pushed in a direction which tends to impart sliding movement across the seat portion.

Such lateral movement of the padded element is prevented by the projections. However, due to this lateral urging, damage often occurs, and frequently the material at or adjacent to the projections can be torn or damaged, and one or more projections can actually be torn away.

The present invention therefore seeks to provide a solution to this problem, without significantly impeding simple removal of the padded element.

SUMMARY OF THE INVENTION

According to a first aspect of the present invention, there is provided a padded shower seat for use when showering, the shower seat comprising a seat element having one or more openings therein, and a padded element engaged with the seat element, the padded element including one or more integrally formed projections push-fit received in a respective said opening and at least one reinforcing element associated with at least one said projection for preventing or inhibiting unintentional disengagement of the padded element from the seat element, or damage to the padded element, during lateral urging of the padded element parallel to the seat element.

According to a second aspect of the invention, there is provided a water-resistant padded element specifically adapted for use as the padded element of the padded shower seat in accordance with the first aspect of the invention, the padded element comprising a padded seat portion and one or more projections integrally formed on the seat portion and push-fit receivable in a respective opening of a seat element of the shower seat, and at least one reinforcing element associated with at least one said projection for preventing or inhibiting unintentional disengagement of the padded element when engaged with the seat element, or damage to the padded element, during lateral urging of the padded element parallel to the seat element.

According to a third aspect of the invention, there is provided a reinforcing element specifically adapted for use as the reinforcing element of the padded shower seat in accordance with the first aspect of the invention, the reinforcing element being in the form of a flared collar having an opening through which the projection of the padded element of the shower seat is receivable.

The present invention will now be more particularly described, by way of example only, with reference to the accompanying drawings.

BRIEF DESCRIPTION OF THE DRAWINGS

FIG. 5 is a cross-section through a second embodiment of the shower seat, showing a projection of the padded element, a reinforcing element and a locking element;

FIG. 6 is a perspective view of the locking element;

FIG. 7 is an elevational view of the locking element, from one side;

FIG. 8 is an elevational view of the locking element, from another side;

FIG. 9 is a cross-sectional view of the locking element, taken along line A-A in FIG. 8;

DESCRIPTION OF THE PREFERRED EMBODIMENTS

Referring firstly to FIGS. 1 to 4, there is shown a shower seat 10 for use when showering. The shower seat 10 is waterproof or water-resistant, and is typically formed entirely or primarily from moulded plastics. For example, instead of plastics, the supporting legs can be formed from metal, such as stainless steel or aluminium, and fixing brackets for attaching the seat to a wall may be metal.

Figure 1:
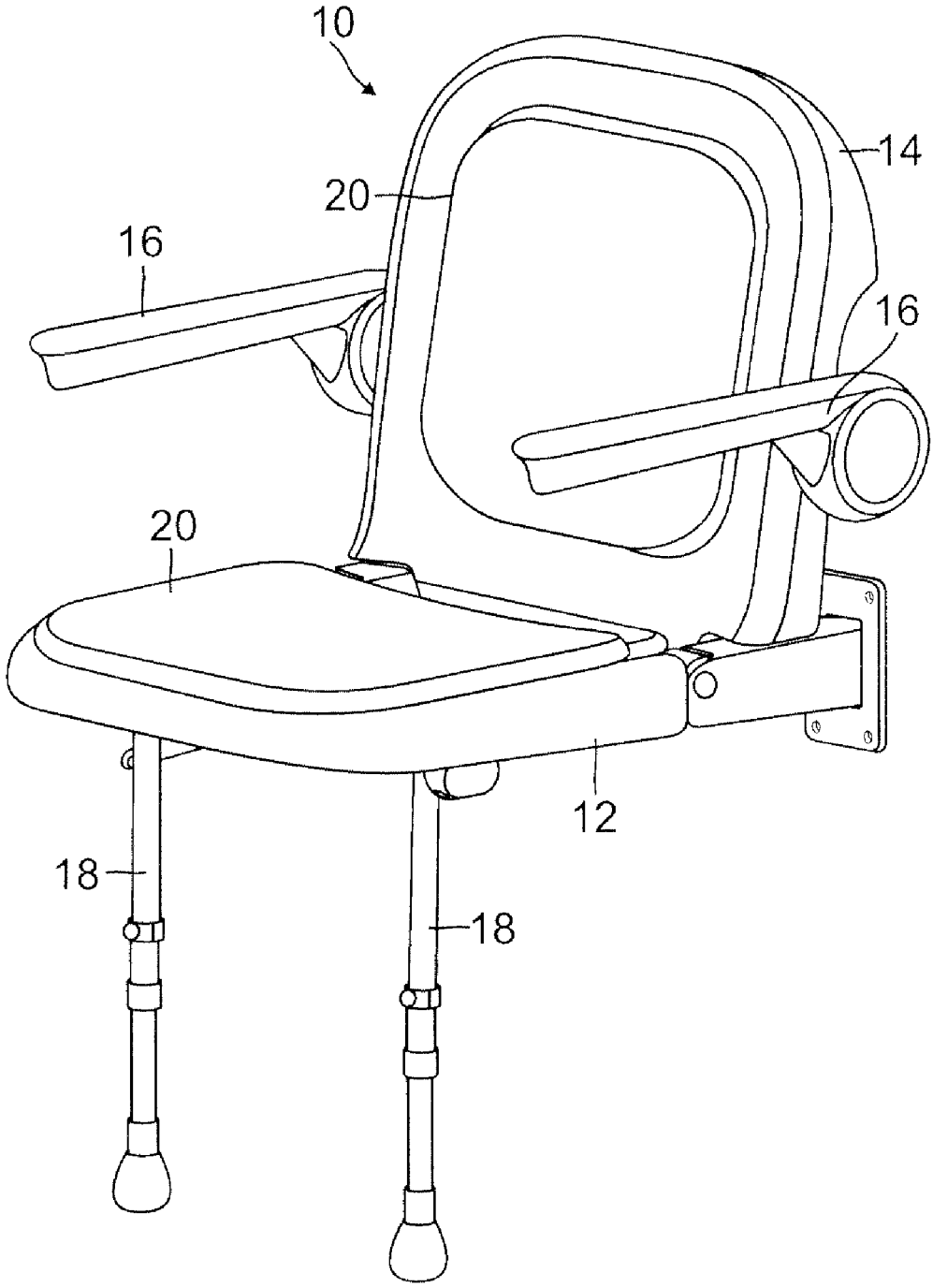
FIG. 1 shows a first embodiment of a shower seat in accordance with the present invention, having a removable padded element with a rigid reinforcing element.
Figure 2:
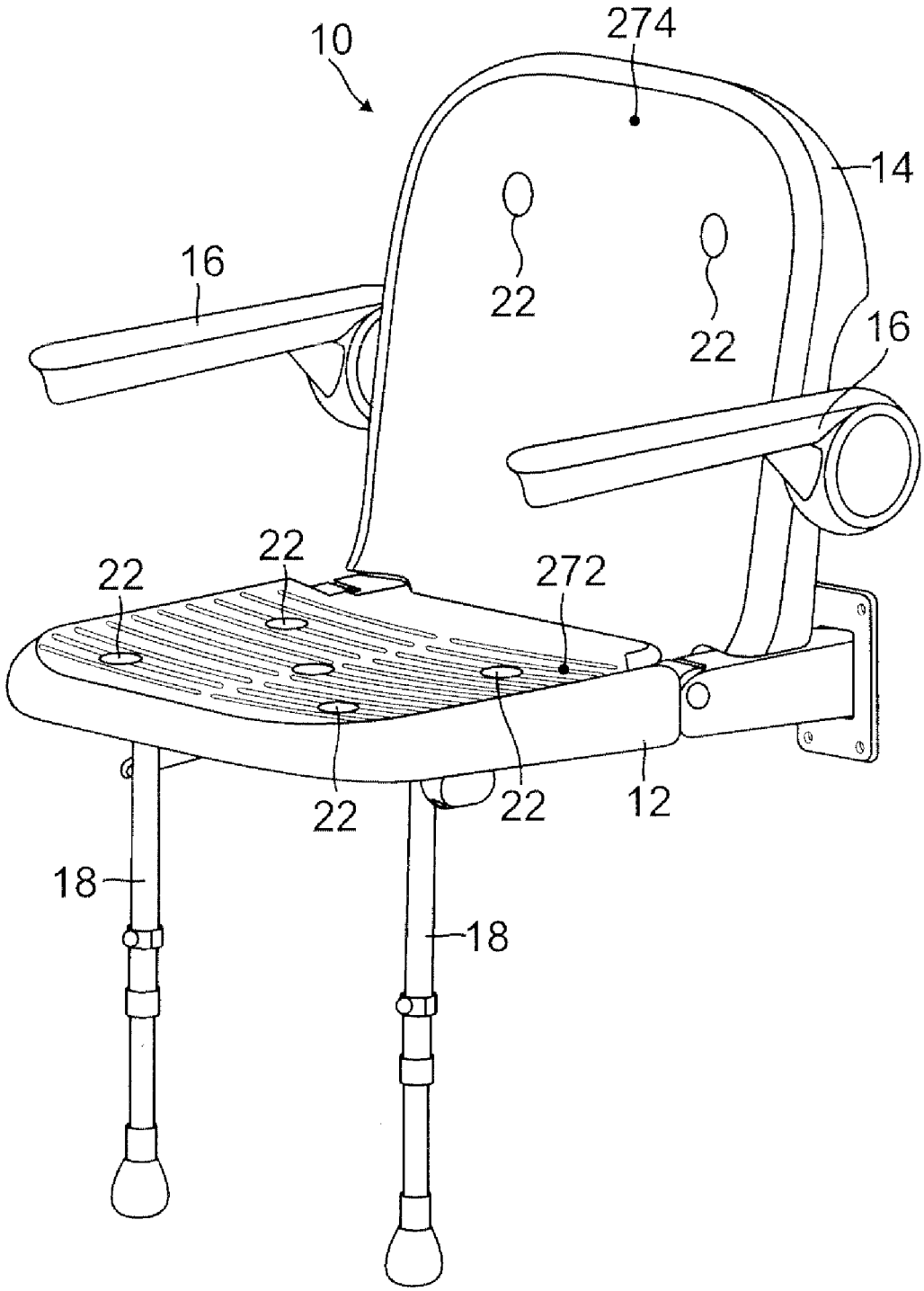
FIG. 2 shows the shower seat of FIG. 1, but with the padded elements removed.
Figure 3:
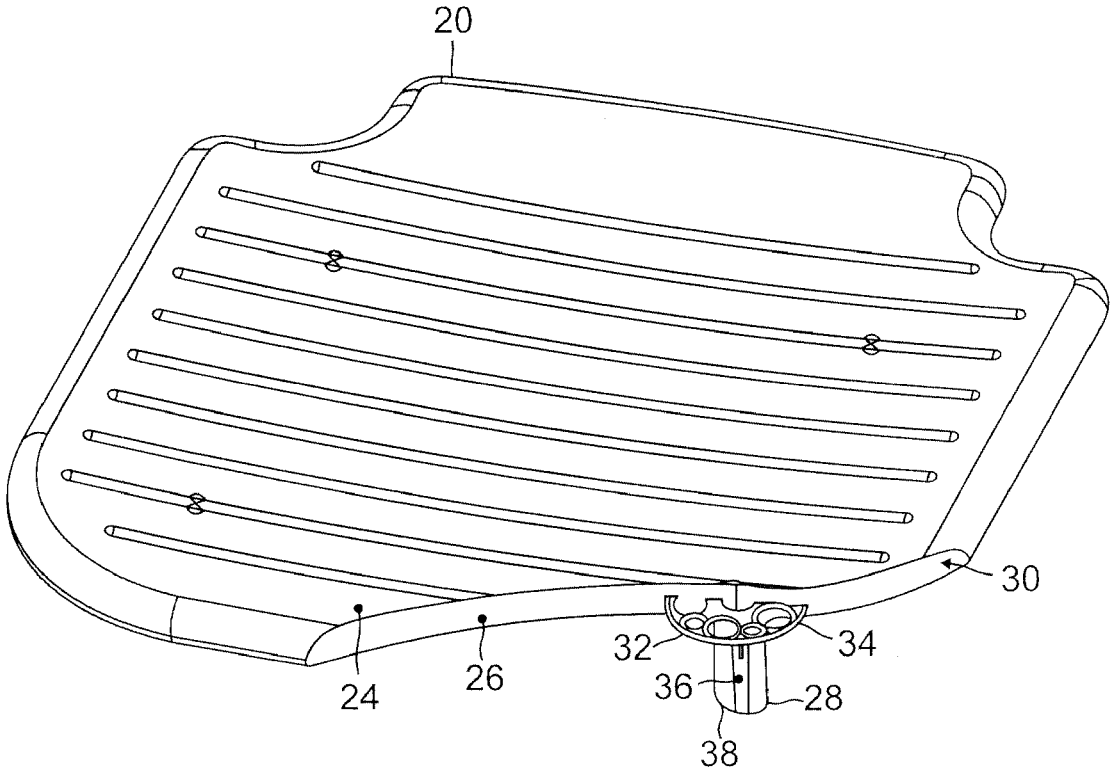
FIG. 3 shows the padded element removed and an integrally formed projection of the padded element partially sectioned to reveal the reinforcing element.
Figure 4:
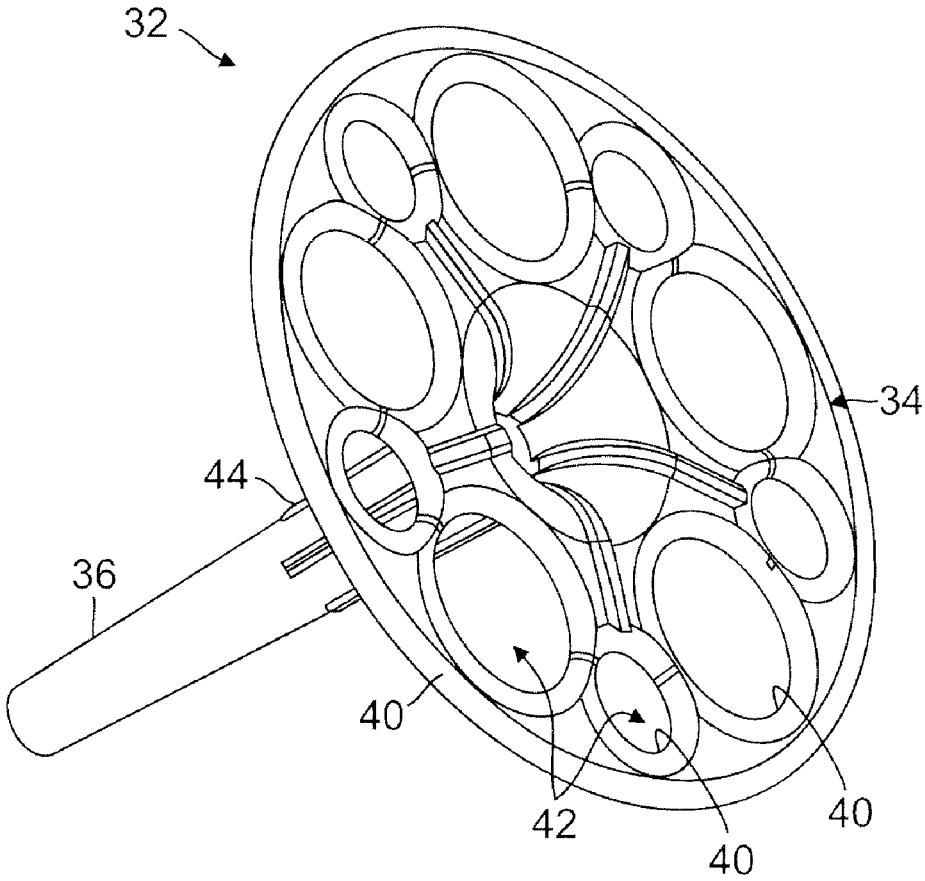
FIG. 4 is an enlarged perspective view of the reinforcing element.

Although the seat shown in FIGS. 1 and 2 is of a hinged variety, being fixedly hinged to a shower room wall, typically beneath a shower head, the shower seat can be free-standing and thus freely repositionable within the shower room.

The shower seat 10 comprises a seat element 12, which in this embodiment is hinged, but which can be fixed, a seat back 14, preferably with two pivotable arms 16, two pivotable legs 18, and two padded cushion-like elements 20. Again, the arms 16 and/or the legs 18 can be fixed, rather than hinged.

The seat element 12 supports a user and includes a plurality of, typically circular, spaced openings 22. The openings 22 are conveniently apertures, thus allowing drainage through the seat element 12. However, the openings 22 can be recesses in the first and third embodiments.

The seat back 14 also includes a plurality of spaced openings 22, similar to those provided in the seat element 12.

Each padded element 20 is preferably formed from self-skinning closed-cell foam having an outer skin 24 and with a sponge core 26. A plurality of lugs or projections 28 are integrally formed on an under side of a seat portion 30 of the padded element 20. Each projection 28 corresponds to a said opening 22 in the seat element 12 or the seat back 14, and is dimensioned to be a push- or interference-fit in the opening 22.

To prevent or inhibit damage to the projections 28, a plurality of reinforcing elements 32 is provided, at least one in each padded element 20. Each reinforcing element 32 is rigid or substantially rigid and is typically formed from plastics material. Each reinforcing element 32 includes a disk-shaped upper portion 34 which is positioned in the seat portion 30 of the padded element 20, and an elongate hollow shaft 36 which extends centrally down each projection 28. The hollow shaft 36 terminates at or adjacent to a free distal end 38 of the projection 28, remote from the seat portion 30.

The reinforcing element 32 is generally buccinal or trumpet shaped, with the shaft 36 forming a smoothly flaring funnel of circular cross-section as it approaches and reaches the upper portion 34. The upper portion 34 itself is planar or substantially planar.

All edges on the disk-shaped upper portion 34 of the reinforcing element 32 have over-sized perimeter edges 40 of generally circular or part-circular lateral cross-section. This prevents or inhibits the reinforcing element 32 cutting into the encasing core material during use.

To further retain the reinforcing element 32 in place, the disk-shaped upper portion 34 is formed with a plurality of closely spaced apertures 42. The encasing core material, during moulding, thus enters the apertures 42 and, once cured, holds the reinforcing element 32 firmly in place.

Ridges 44 are formed on an exterior surface of the shaft 36, again to prevent or inhibit movement of the reinforcing element 32 within the projection 28.

During use, the reinforcing element 32 significantly reinforces and stiffens the projection 28, making the padded element 20 much more resilient and able to accept lateral urging forces through user-transfer or sliding movement, without resulting in damage.

Although it is suggested that each projection 28 includes an independent reinforcing element 32, only some of the projections 28 may include a reinforcing element 32.

Furthermore, the reinforcing element can be a sheet or strip having multiple shafts for location within a plurality of projections 28, instead of providing an independent reinforcing element for each projection.

Referring now to FIGS. 5 to 9, a second embodiment of a shower seat 110 will now be described. The shower seat 110 of this embodiment is the same as that described above, except that a locking element 146 is additionally provided.

The locking element 146 is generally ovate shaped, with recessed side scalloped regions 156 in the upper portion of the body which form convenient hand and finger clasping points. See, for example, FIG. 7.

The locking element 146 is formed from moulded plastics and includes a body 148 having a projecting flange portion 150, a recess 152 formed within the body 148, a screw-threaded male spigot 154 fully or substantially fully housed within the recess 152, and two opposing digit-engaging formations 156 formed on sides of the body 148 and spaced from the recess 152.

All edges of the locking element 146, including a free distal end 158 of the male spigot 154, are smoothed or rounded to limit the possibility of injury, especially to an elderly person with fragile skin.

The screw-thread 160 of the male spigot 154 is self-cutting or self-tapping.

During the manufacturing process for the cushion with reinforcements, the reinforcing element is typically placed upon a location pin present in the foaming cavity tool, thus the shaft 36 of the reinforcing element 32 of the first embodiment terminates at or adjacent to the free distal end 38 of the projection 28 of the padded element 20, the male spigot 154 of the locking element 146 can be introduced into the hollow shaft 36 and screw-threadingly engaged. A user grasps the body 148 of the locking element 146 via the digit-engaging formations 156, and without the need of any tool. The self-tapping thread 160 cuts and engages with an interior surface of the hollow shaft 36. As the user turns the locking element 146, the male spigot 154 is wound up inside the shaft 36 of the reinforcing element 32, and the projection 28 of the padded element 20 is drawn into the recess 152 of the body 148 of the locking element 146. The flange portion 150 of the locking element 146 projects sufficiently to overlap the opening 22 of the seat element 12 or seat back 14, thereby preventing extraction of the projection 28 from the opening 22. The padded element 20 can thus be releasably fastened in place, and easily removed as necessity dictates.

Figure 10:
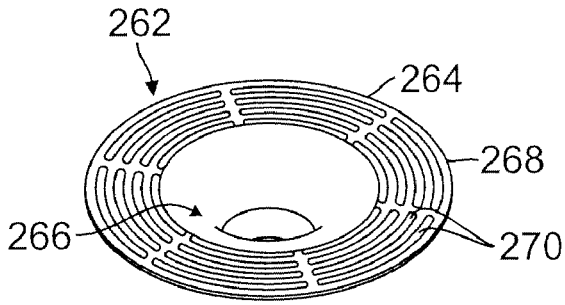
FIG. 10 is a perspective view of another reinforcing element, in accordance with a third embodiment of the shower seat.
Figure 11:
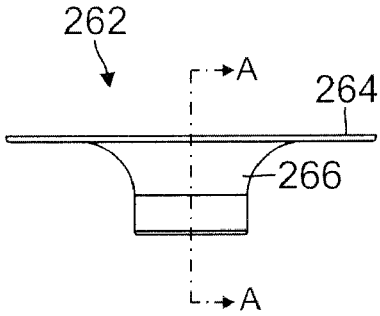
FIG. 11 is an elevational view of the reinforcing element shown in FIG. 10.
Figure 12:
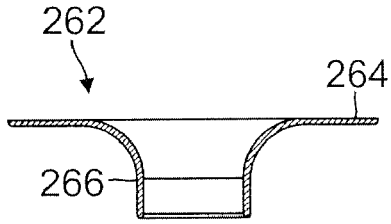
FIG. 12 is a cross-sectional view of the reinforcing element, taken along line A-A in FIG. 11.
Figure 13:
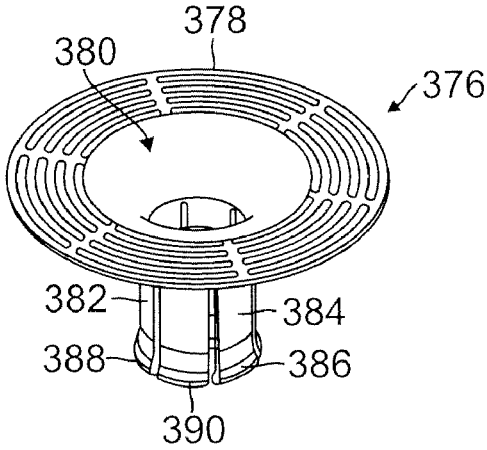
FIG. 13 is a perspective view from above of yet another reinforcing element, in accordance with a fourth embodiment of the shower seat.
Figure 14:
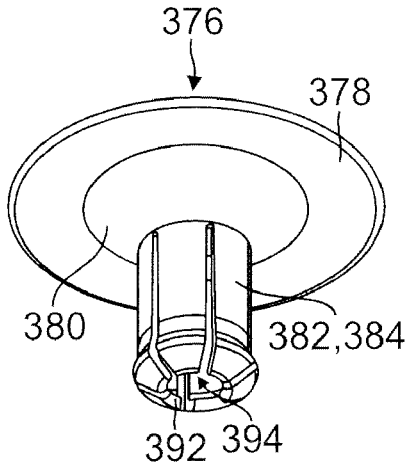
FIG. 14 is a perspective view from below of the reinforcing element shown in FIG. 13.
Figure 15:
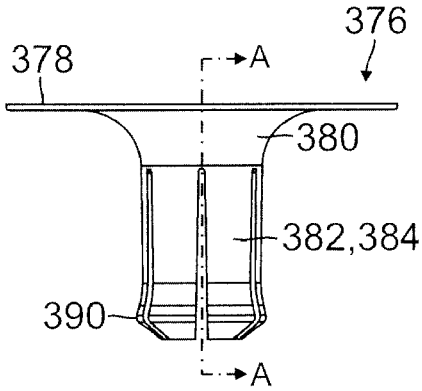
FIG. 15 is an elevational view of the reinforcing element shown in FIG. 13.
Figure 16:
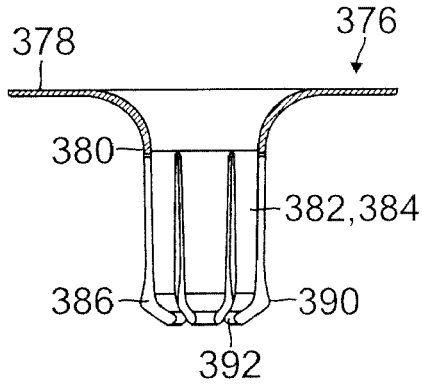
FIG. 16 is a cross-sectional view of the reinforcing element, taken along line A-A in FIG. 15.

Referring now to FIGS. 10 to 12, a third embodiment of a shower seat will now be described. The shower seat of this embodiment is the same as that described with reference to the first and second embodiments, except that, in addition to or as an alternative to the above-described reinforcing element 32, another reinforcing element 262 is provided.

The reinforcing element 262 of this embodiment is in the form of a, typically moulded plastics, collar for the projection 28 of the padded element 20. The collar 262 comprises a disk-shaped upper portion 264 for contact with a lower surface of the padded element 20, adjacent to the projection 28, and a smoothly flaring funnel-shaped portion 266 in which the projection 28 is received as a push- or interference-fit. The collar 262 thus has a generally buccinal or trumpet-like shape.

An upper surface 268 of the upper portion 264 of the collar 262 includes a plurality of channels 270. The collar 262 can be bonded to the lower surface of the padded element 20, and the channels 270 aid in retaining adhesive and promoting bonding.

The disk-shaped upper portion 264 sits on an upper surface 272 (shown in FIG. 2) of the seat element 12 or a forward-facing surface 274 of the seat back 14, and the funnel-shaped portion 266 extends into the respective opening 22. The collar 262 thus aids in spreading load imparted through lateral urging of the padded element 20, again resulting in the protection of the projections 28.

Referring now to FIGS. 13 to 16, a fourth embodiment of a shower seat will now be described. The fourth embodiment is similar to the third embodiment, except that a modified collar 376 is provided.

The modified collar 376 of this embodiment includes a disk-shaped upper portion 378 for abutment with a lower surface of the padded element 20, and a smoothly flaring funnel-shaped portion 380 for receiving the projection 28.

However, a plurality of closely-spaced gripping elements 382 is also provided, integrally formed as part of the collar 376 and arranged to surround the projection 28. Each gripping element 382 is an elongate flexible independent arm 384 which extends from a lower edge of the funnel-shaped portion 380, in a direction away from the disk-shaped upper portion 378. The arm 384 includes a cranked portion 386 at its free distal end 388, remote from the funnel-shaped portion 380. The cranked portion 386 defines an outwardly projecting ridge 390, and an inwardly extending gripping edge 392.

The projection 28 of the padded element 20 is pushed through the collar 376. The inwardly extending gripping edges 392 of the arms 384 define an opening 394 of smaller diameter than the projection 28. As such, the gripping edges 392 dig into an exterior surface of the projection 28, once it is received through the opening 394, to hold the collar 376 firmly to the projection 28.

With the padded element 20 positioned on the seat element 12 or the seat back 14, the or each collar 376 extends fully through the opening 22. As such, the arms 384 tend to be slightly outwardly biased by the projection 28, causing the ridges 390 of the arms 384 to interfere and engage with the seat element 12 or the seat back 14 adjacent to the opening 22. This again prevents or inhibits unintentional extraction of the projection 28 from the opening 22, and thus also unintentional removal of the padded element 20 from the seat element 12 or the seat back 14.

Only a single padded element can be provided on the seat element.

The seat back can be dispensed with.

The padded element associated with the seat back need not have the reinforcing element or elements, since it is primarily lateral urging forces imparted to the padded element on the seat element which results in damage to the integrally formed projections.

Again, as with the first embodiment, a plurality of collars can be provided in the form of a single sheet or strip, rather than an independent collar for each projection.

The above-described collar can be retrofitted to existing padded elements.

As with the first and second embodiments, it is preferable that all edges of the collars of the third and fourth embodiments are smooth or rounded to prevent or limit the possibility of injury.

The embodiments described above are given by way of examples only, and various other modifications will be apparent to persons skilled in the field without departing from the scope of the appended claims.

What is claimed is:

1. A padded shower seat for use when showering, the shower seat comprising a seat element having at least one opening therein, and a cushioning material engaged with the seat element, the cushioning material having a base and including at least one projection push-fit received in a respective said opening and at least one reinforcing element in the form of a smoothly flared funnel, the reinforcing element encased within the cushioning material and partially surrounding at least a portion of at least one said projection for preventing or inhibiting unintentional disengagement of the padded element from the seat element, or damage to the cushioning material, during lateral urging of the cushioning material parallel to the seat element, wherein the at least one projection is integrally formed with the base and the at least one reinforcing element is integrally formed with the base.

2. A padded shower seat as claimed in claim 1, wherein the reinforcing element includes a buccinal or trumpet shape.

3. A padded shower seat as claimed in claim 1, wherein the reinforcing element includes a plurality of apertures to receive interior padding of the padded element.

4. A padded shower seat as claimed in claim 1, wherein the reinforcing element includes a shaft having an opening therein to receive a locking element.

5. A padded shower seat as claimed in claim 1, further comprising a locking element which is receivable within the projection and which is releasably engagable with the reinforcing element, the locking element, when engaged with the reinforcing element, preventing extraction of the projection from the opening of the seat element.

6. A padded shower seat as claimed in claim 5, wherein the locking element is engagable with and disengagable from the reinforcing element solely by hand and without a tool.

7. A padded shower seat as claimed in claim 5, wherein the locking element includes a flanged body, a recess formed in the body, and a male spigot which is provided in the recess and which is engagable with the reinforcing element.

* * * * *